US008888219B2

(12) United States Patent
Tanase et al.

(10) Patent No.: US 8,888,219 B2
(45) Date of Patent: Nov. 18, 2014

(54) METHOD OF ACQUIRING CORRECTION VALUE AND METHOD OF MANUFACTURING LIQUID DISCHARGING APPARATUS

(71) Applicant: Seiko Epson Corporation, Tokyo (JP)

(72) Inventors: Kazuyoshi Tanase, Matsumoto (JP); Tsuneo Kasai, Azumino (JP); Toru Takahashi, Azumino (JP); Masahiro Fukazawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/228,664

(22) Filed: Mar. 28, 2014

(65) Prior Publication Data

US 2014/0292863 A1 Oct. 2, 2014

(30) Foreign Application Priority Data

Mar. 29, 2013 (JP) ..... 2013-071625

(51) Int. Cl.
*B41J 2/12* (2006.01)

(52) U.S. Cl.
CPC ..... *B41J 2/12* (2013.01)
USPC ..... 347/13; 347/41; 347/78

(58) Field of Classification Search
CPC ..... B41J 2/145; B41J 3/54; B41J 2/04505; B41J 2/2132; H01L 51/0005
USPC ..... 347/9, 12–16, 19, 40–43, 78
See application file for complete search history.

(56) References Cited

U.S. PATENT DOCUMENTS 6,742,866 B2 * 6/2004 Anderson et al. ..... 347/40
7,350,899 B2 * 4/2008 Kiguchi et al. ..... 347/40

FOREIGN PATENT DOCUMENTS

JP 2010-105289 5/2010

* cited by examiner

*Primary Examiner* — Thinh Nguyen
(74) *Attorney, Agent, or Firm* — Workman Nydegger

(57) ABSTRACT

There is provided a method of acquiring a correction value of a liquid discharging apparatus that includes a first nozzle row, a second nozzle row, a third nozzle row, and a fourth nozzle row, the method includes: acquiring the amount of deviation (heterogeneous row error) of a dot formed by the third nozzle row in the predetermined direction, acquiring the amount of deviation (overlapping area error) between the dot formed by the third nozzle row and a dot formed by the fourth nozzle row in the predetermined direction, and acquiring a correction value which causes discharge data assigned to the fourth nozzle row to shift in the predetermined direction based on the heterogeneous row error and the overlapping area error.

5 Claims, 7 Drawing Sheets

METHOD OF ACQUIRING CORRECTION VALUE AND METHOD OF MANUFACTURING LIQUID DISCHARGING APPARATUS

BACKGROUND

1. Technical Field

The present invention relates to a method of acquiring a correction value and a method of manufacturing a liquid discharging apparatus.

2. Related Art

An ink jet printer, which prints an image having a nozzle row width in such a way that ink (liquid) is discharged from nozzle rows while the nozzle rows, in which a plurality of nozzles are placed in a predetermined direction (Y direction), and a recording medium are relatively moved in a direction crossing the predetermined direction (X direction), is known as an example of a liquid discharging apparatus. In addition, there is a case in which a plurality of nozzle rows are placed in the Y direction in order to print an image having a large width. In this case, it is possible to prevent a portion, which is printed at a joint of the nozzle rows, from being distinguished by causing the positions of the end parts of the nozzle rows which are adjacent in the Y direction to partially overlap. Further, a method of adjusting the number or combination of pair nozzles that form a single raster line with two nozzles which belong to different nozzle rows in an overlapping area of the nozzle rows which are adjacent in the Y direction based on the attachment error of the nozzle rows which are adjacent in the Y direction is proposed (refer to JP-A-2010-105289).

According to JP-A-2010-105289, it is possible to prevent an image from being deteriorated due to the attachment error of the same color nozzle rows which are adjacent in the Y direction. However, if only the attachment error of the same color nozzle rows which are adjacent in the Y direction is taken into consideration in a case of a printer configured in such a way that a plurality of nozzle row groups, in which a plurality of nozzle rows are placed in the Y direction, are placed in an X direction and each of the nozzle row groups discharges different color ink, there is a problem in that deviation of different color dot formation position becomes worse due to the attachment error of a nozzle row which discharges another color ink with regard to a nozzle row which discharges arbitrary color ink, and thus an image is deteriorated.

SUMMARY

An advantage of some aspects of the invention is to prevent an image from being deteriorated due to the attachment error of nozzle rows, which are placed in a predetermined direction and discharge the same liquid, and the attachment error of nozzle rows which are placed in a direction crossing the predetermined direction and discharge different liquid.

There is provided a method of acquiring a correction value of a liquid discharging apparatus that includes a first head having a first nozzle row formed in such a way that a plurality of first nozzles for discharging first liquid are placed in predetermined inter-nozzle pitch in a predetermined direction, a second head having a second nozzle row formed in such a way that a plurality of second nozzles for discharging the first liquid are placed in the predetermined inter-nozzle pitch in the predetermined direction, a third head having a third nozzle row formed in such a way that a plurality of third nozzles for discharging second liquid, a color of which is different from a color of the first liquid, are placed in the predetermined inter-nozzle pitch in the predetermined direction, and a fourth head having a fourth nozzle row formed in such a way that a plurality of fourth nozzles for discharging the second liquid are placed in the predetermined inter-nozzle pitch in the predetermined direction, in which a part of the first nozzle row overlaps with a part of the second nozzle row and a part of the third nozzle row overlaps with a part of the fourth nozzle row when viewed from a direction crossing the predetermined direction, the method including, acquiring a first heterogeneous row error which is an amount of deviation of a dot formation position actually formed by the third nozzle row in the predetermined direction with regard to the ideal position when a dot formation position formed by the first nozzle row is a reference position and a dot formation position, in which a dot formation position formed by the third nozzle row is an ideal position with regard to the reference position, is an ideal position; acquiring a first overlapping area error which is an amount of deviation between a dot formation position formed by the first overlapping nozzle and a dot formation position formed by a second overlapping nozzle in the predetermined direction when viewed from a direction crossing the predetermined direction and when one of the third nozzles which is located in an overlapping area where the third nozzle row overlaps with the fourth nozzle row is a first overlapping nozzle and a nozzle in the plurality of fourth nozzles, which is capable of forming a dot having a closest dot formation position to the dot formation position formed by the first overlapping nozzle in the predetermined direction is the second overlapping nozzle; and acquiring a first correction value which causes discharge data assigned to the fourth nozzle row to shift in the predetermined direction based on the first heterogeneous row error and the first overlapping area error.

Other features of the invention will be apparent based on the description of the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Overview of Disclosure

Figure 1A:
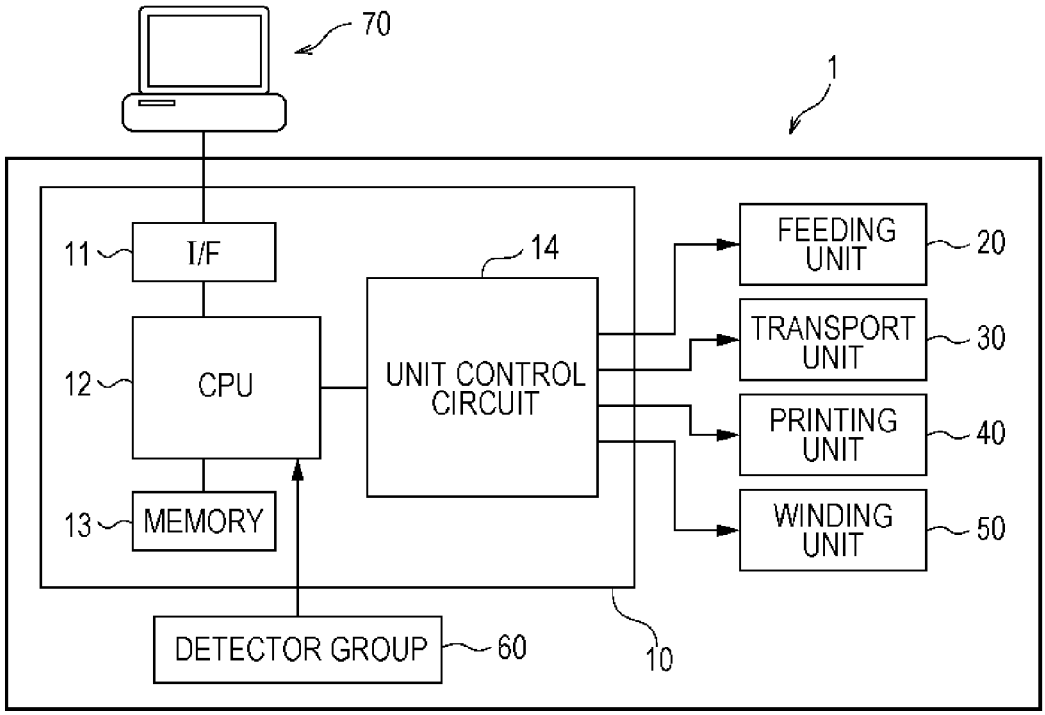
FIG. 1A is a block diagram illustrating the entire configuration of a printing system.

At least the followings are apparent based on the specification and the accompanying drawings.

There is provided a method of acquiring a correction value of a liquid discharging apparatus that includes a first head having a first nozzle row formed in such a way that a plurality of first nozzles for discharging first liquid are placed in predetermined inter-nozzle pitch in a predetermined direction, a second head having a second nozzle row formed in such a way that a plurality of second nozzles for discharging the first liquid are placed in the predetermined inter-nozzle pitch in the predetermined direction, a third head having a third nozzle row formed in such a way that a plurality of third nozzles for discharging second liquid, a color of which is different from a color of the first liquid, are placed in the predetermined inter-nozzle pitch in the predetermined direction, and a fourth head having a fourth nozzle row formed in such a way that a plurality of fourth nozzles for discharging the second liquid are placed in the predetermined inter-nozzle pitch in the predetermined direction, in which a part of the first nozzle row overlaps with a part of the second nozzle row and a part of the third nozzle row overlaps with a part of the fourth nozzle row when viewed from a direction crossing the predetermined direction, the method including, acquiring a first heterogeneous row error which is an amount of deviation of a dot formation position actually formed by the third nozzle row in the predetermined direction with regard to the ideal position when a dot formation position formed by the first nozzle row is a reference position and a dot formation position, in which a dot formation position formed by the third nozzle row is an ideal position with regard to the reference position, is an ideal position; acquiring a first overlapping area error which is an amount of deviation between a dot formation position formed by the first overlapping nozzle and a dot formation position formed by a second overlapping nozzle in the predetermined direction when viewed from a direction crossing the predetermined direction and when one of the third nozzles which is located in an overlapping area where the third nozzle row overlaps with the fourth nozzle row is a first overlapping nozzle and a nozzle in the plurality of fourth nozzles, which is capable of forming a dot having the closest dot formation position to the dot formation position formed by the first overlapping nozzle in the predetermined direction is the second overlapping nozzle; and acquiring a first correction value which causes discharge data assigned to the fourth nozzle row to shift in the predetermined direction based on the first heterogeneous row error and the first overlapping area error.

In the method, it is possible to prevent the deterioration of an image (the deviation of the dot formation position formed by pair nozzles which belong to the overlapping area and form the same dot row) due to the attachment error of the nozzle rows which are placed in the predetermined direction and discharge the same liquid, and it is possible to prevent the deterioration of the image (the deviation of the dot formation position formed by different liquid) due to the attachment error of the nozzle rows which discharge the different liquid.

In the method, the acquiring of the first correction value may include: using a value, acquired by adding the inter-nozzle pitch to the first overlapping area error, as a first correction error, and acquiring a first evaluation value using the first correction error and the first heterogeneous row error; using a value, acquired by subtracting the inter-nozzle pitch from the first overlapping area error, as the first correction error, and acquiring a second evaluation value using the first correction error and the first heterogeneous row error; using the first overlapping area error as the first correction error, and acquiring a third evaluation value using the first correction error and the first heterogeneous row error; and determining the first correction value based on a first minimum correction error which is the first correction error of an evaluation value having a smallest absolute value from among the first to third evaluation values.

In the method, it is possible to acquire the correction value by taking the attachment error (overlapping area error) of the nozzle rows which are placed in the predetermined direction and discharge the same liquid and the attachment error (heterogeneous row error) of the nozzle rows which discharge the different liquid into consideration.

The method may further include acquiring the evaluation value using a value acquired by adding an absolute value of a value, which is acquired by multiplying the first minimum correction error by a first weighting coefficient, to an absolute value of a value, which is acquired by multiplying a value acquired by adding the first minimum correction error to the first heterogeneous row error by a second weighting coefficient.

In the method, it is possible to acquire the correction value by taking the attachment error (overlapping area error) of the nozzle rows which are placed in the predetermined direction and discharge the same liquid and the attachment error (heterogeneous row error) of the nozzle rows which discharge the different liquid into consideration.

In the method, the liquid discharging apparatus may further include a fifth head having a fifth nozzle row formed in such a way that a plurality of fifth nozzles for discharging the second liquid are placed in the predetermined inter-nozzle pitch in the predetermined direction, and the third nozzle row does not overlap with the fifth nozzle row and the part of the fourth nozzle row overlaps with a part of the fifth nozzle row, when viewed from a direction crossing the predetermined direction, the method may further include: acquiring a second overlapping area error which is an amount of deviation between a dot formation position formed by a third overlapping nozzle and a dot formation position formed by a fourth overlapping nozzle in the predetermined direction when viewed from a direction crossing the predetermined direction and when one of the fourth nozzles, which is located in an overlapping area where the fourth nozzle row overlaps with the fifth nozzle row is the third overlapping nozzle and a nozzle in the plurality of fifth nozzles, which is capable of forming a dot having a closest dot formation position to the dot formation position formed by the third overlapping nozzle in the predetermined direction is the fourth overlapping nozzle; and acquiring a second correction value which causes discharge data assigned to the fifth nozzle row to shift in the predetermined direction, and in which the acquiring of the second correction value may include acquiring the second correction value based on the first minimum correction error, the first heterogeneous row error, and the second overlapping area error.

In the method, the acquiring of the correction values may include acquiring the correction value in order from the second nozzle row which is close to a second reference nozzle row while using a second reference nozzle row as a starting point.

In the method, it is possible to acquire the correction value by taking the amount of shift of the discharge data from the second reference nozzle row to a target second nozzle row into consideration.

In the method, the correction value, which causes discharge data assigned to the each first nozzle row to shift in the predetermined direction, may be acquired by using the overlapping area error of a first nozzle row group.

In the method, it is possible to make the method of acquiring the correction value easy, and it is possible to shorten a correction value acquisition time.

The method may include forming a pattern for each overlapping area between the nozzle rows which are adjacent in the predetermined direction, and the pattern may include dot row groups in which dot rows, which are respectively formed by the first nozzle rows that are adjacent in the predetermined direction and the second nozzle rows that are adjacent in the predetermined direction and which extend in the direction crossing the predetermined direction, are placed in the predetermined direction.

In the method, it is possible to acquire the correction value, from which the transport error of a recording medium and the read error of an image reading device are reduced, when the pattern is formed.

In the method, in the pattern, a plurality of dot row groups may be placed in the direction crossing the predetermined direction, and nozzles which form each of the dot row groups may be different.

In the method, it is possible to acquire the correction value from which difference between the discharge properties of the nozzles is reduced.

In addition, there is provided a method of manufacturing a liquid discharging apparatus that includes a first head having a first nozzle row formed in such a way that a plurality of first nozzles for discharging first liquid are placed in predetermined inter-nozzle pitch in a predetermined direction, a second head having a second nozzle row formed in such a way that a plurality of second nozzles for discharging the first liquid are placed in the predetermined inter-nozzle pitch in the predetermined direction, a third head having a third nozzle row formed in such a way that a plurality of third nozzles for discharging second liquid, a color of which is different from a color of the first liquid, are placed in the predetermined inter-nozzle pitch in the predetermined direction, a fourth head having a fourth nozzle row formed in such a way that a plurality of fourth nozzles for discharging the second liquid are placed in the predetermined inter-nozzle pitch in the predetermined direction, and a storage section, in which a part of the first nozzle row overlaps with a part of the second nozzle row and a part of the third nozzle row overlaps with a part of the fourth nozzle row when viewed from a direction crossing the predetermined direction, the method including: acquiring a first heterogeneous row error which is an amount of deviation of a dot formation position actually formed by the third nozzle row in the predetermined direction with regard to the ideal position when a dot formation position formed by the first nozzle row is a reference position and a dot formation position, in which a dot formation position formed by the third nozzle row is an ideal position with regard to the reference position, is an ideal position; acquiring a first overlapping area error which is an amount of deviation between a dot formation position formed by a first overlapping nozzle and a dot formation position formed by a second overlapping nozzle in the predetermined direction when viewed from a direction crossing the predetermined direction and when one of the third nozzles which is located in an overlapping area where the third nozzle row overlaps with the fourth nozzle row is the first overlapping nozzle and a nozzle in the plurality of fourth nozzles, which is capable of forming a dot having a closest dot formation position to the dot formation position formed by the first overlapping nozzle in the predetermined direction is the second overlapping nozzle; acquiring a first correction value which causes discharge data assigned to the fourth nozzle row to shift in the predetermined direction based on the first heterogeneous row error and the first overlapping area error; and storing the first correction value in the storage section.

In the method, it is possible to prevent the deterioration of an image (the deviation of the dot formation position formed by pair nozzles which belong to the overlapping area and form the same dot row) due to the attachment error of the nozzle rows which are placed in the predetermined direction and discharge the same liquid, and it is possible to prevent the deterioration of the image (the deviation of the dot formation position formed by different liquid) due to the attachment error of the nozzle rows which discharge the different liquid.

Printing System

Hereinafter, it is assumed that a liquid discharging apparatus is an ink jet printer (hereinafter, referred to as a printer), and embodiments will be described using a printing system in which a computer is connected to the printer as an example.

Figure 1B:
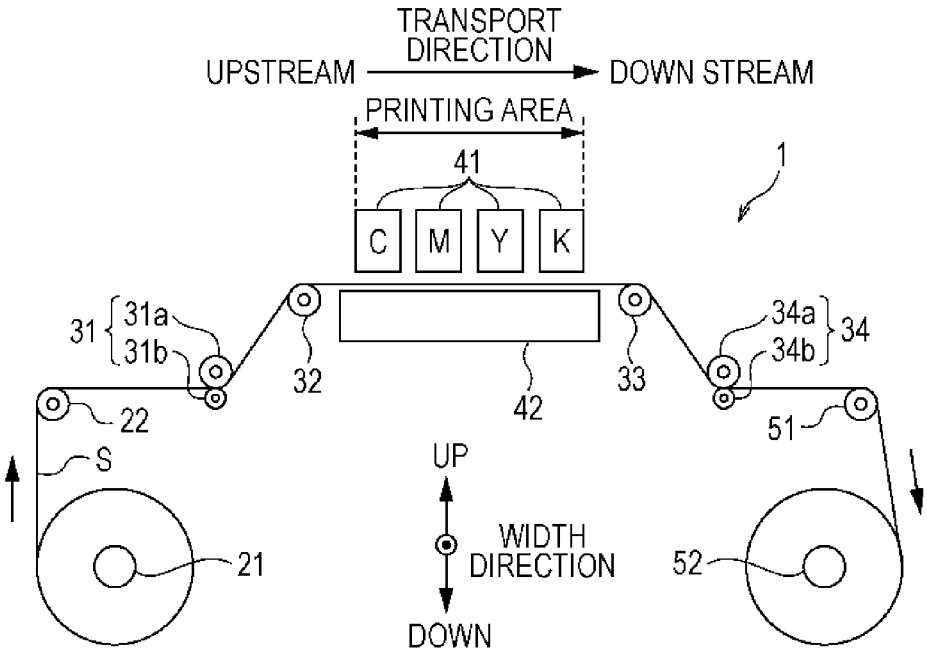
FIG. 1B is a schematic sectional diagram illustrating a printer.
Figure 2:
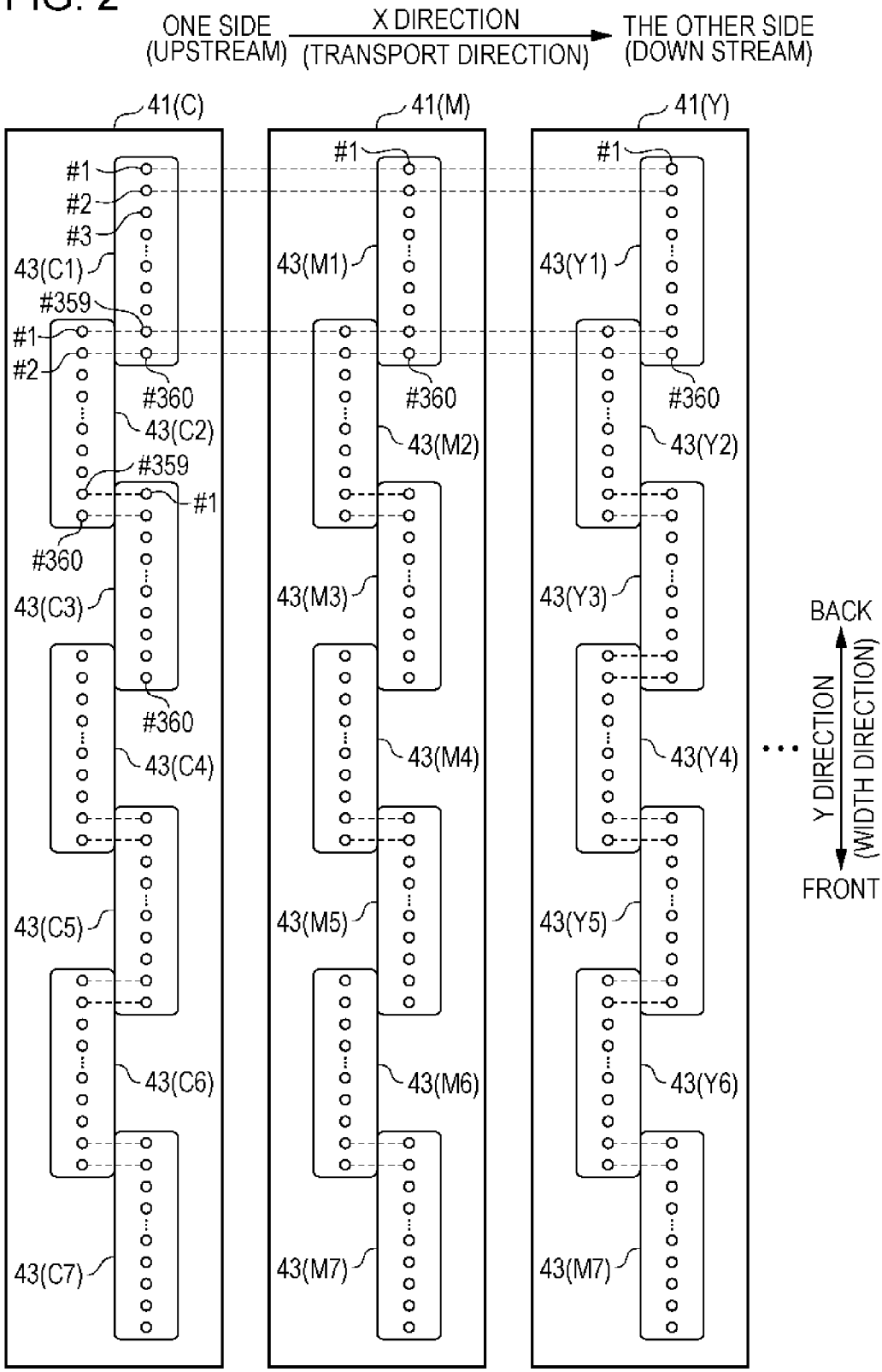
FIG. 2 is a view illustrating the arrangement of heads in head units.

FIG. 1A is a block diagram illustrating the entire configuration of a printing system, and FIG. 1B is a schematic sectional diagram illustrating a printer 1. FIG. 2 is a view illustrating the arrangement of heads 43 in each of the head units 41. Meanwhile, FIG. 2 virtually illustrates the positions of the heads 43 and nozzles when the head units 41 are viewed from above. The printer 1 is communicably connected to a computer 70, and a printer driver that is installed in the computer 70 prepares printing data (discharge data) in order to cause the printer 1 to print an image and outputs the printing data to the printer 1. The printer 1 includes a controller 10, a feeding unit 20, a transport unit 30, a printing unit 40, a winding unit 50, and a detector group 60.

The controller 10 included in the printer 1 is a unit that performs overall control on the printer 1. An interface section 11 performs data transmission and reception with the computer 70 which is provided as an external apparatus or an internal apparatus. A CPU 12 is an arithmetic processing unit for performing overall control on the printer 1, and controls each unit through a unit control circuit 14. A memory 13 is a unit for securing an area for storing programs of the CPU 12, a work area, or the like. A detector group 60 monitors situations in the printer 1 and the controller 10 performs control based on a result of detection from the detector group 60.

The feeding unit 20 includes a winding shaft 21 which rotatably supports a continuous sheet S, which is rolled in a roll shape (hereinafter, referred to as continuous sheet), and sends the continuous sheet S out in accordance with rotation, and a relay roller 22 which winds up the continuous sheet S sent out from the winding shaft 21 and introduces the continuous sheet S to a pair of upstream-side transport rollers 31. Meanwhile, a recording medium on which an image is printed by the printer 1 is not limited to the continuous sheet S. The recording medium may be cut sheet, cloth, a film, and the like.

The transport unit 30 includes a plurality of relay rollers 32 and 33 which wind up and transmit the continuous sheet S, the pair of upstream-side transport rollers 31 which are installed on the upstream side of the transport direction rather than a printing area, and a pair of downstream-side transport rollers 34 which are installed on the downstream side of the transport direction rather than the printing area. The pair of upstream-side transport rollers 31 and the pair of downstream-side transport rollers 34 include driver rollers 31*a* and 34*a* which are connected to a motor (not shown in the drawing) and driven and rotated, and follower rollers 31*b* and 34*b* which rotate in accordance with the rotation of the driver rollers, respectively.

Further, transport force is applied to the continuous sheet S in such a way that the driver rollers 31*a* and 34*a* are driven and rotated in a state in which the pair of upstream-side transport rollers 31 and the pair of downstream-side transport rollers 34 interpose the continuous sheet S therebetween, respectively.

The printing unit 40 includes head units 41 which are provided for the respective ink colors, and a platen 42 which supports the continuous sheet S from an opposite surface of a printing surface in the printing area. The printer 1 according to an embodiment can discharge four color ink, that is, cyan ink (C), magenta ink (M), yellow ink (Y), black ink (K), and the four head units 41 are placed in the transport direction of the continuous sheet S, as shown in FIG. 1B. In each of the head units 41, seven short heads 43(1) to 43(7) are placed in the width direction (Y direction) of the continuous sheet S which is a direction crossing the transport direction (X direction) of the continuous sheet S, as shown in FIG. 2. On a surface (bottom surface) of each of the heads 43, which faces the continuous sheet S, nozzle rows, in which 360 nozzles that discharge ink are placed in the Y direction in predetermined inter-nozzle pitch, are formed. For explanation, small numbers are given (#1, #2 . . . #360) to the nozzles in order from a nozzle which is located on the back side of the Y direction in each nozzle row. In addition, small numbers are given to the heads 43 which belong to the head unit 41 in order from a head 43 which is located on the back side of the Y direction (for example, 43(C1), 43(C2), . . . , and 43(C7) are given in a case of cyan heads 43).

In addition, the heads 43 which are adjacent in the Y direction (corresponding to a predetermined direction) are arranged so as to be deviated in the X direction (corresponding to a direction crossing the predetermined direction), and the positions of end parts of the nozzle rows included in the heads 43 which are adjacent in the Y direction overlap with each other. For example, the positions of the end-part nozzles (#359, #360) of a first cyan head 43(C1) on the front side of the Y direction overlaps with the positions of the end-part nozzles (#1, #2) of a second cyan head 43(C2) on the back side of the Y direction. Therefore, on the bottom surface of the head units 41, the nozzles are placed in predetermined inter-nozzle pitch in the Y direction over the length of the width or longer of the continuous sheet S. Accordingly, a 2-dimensional image is printed on the continuous sheet S in such a way that the head units 41 discharge ink from the nozzles to the continuous sheet S which is transported under the head units 41 without stopping. Meanwhile, in the heads 43 (nozzle rows), a portion in which the positions of the nozzles of the heads 43 which are adjacent in the Y direction is called an overlapping area or is called a joint of the heads 43.

Meanwhile, although the number of heads 43 which are included in the head unit 41 is seven in the embodiment, the invention is not limited thereto. In addition, although the number of nozzle rows which are included in the head 43 is one, the invention is not limited thereto. The number of nozzle rows which are included in the head 43 may be plural and the plurality of nozzle rows may be shifted in the Y direction. In addition, although the number of overlapping nozzles in the heads 43 which are adjacent in the Y direction is two in FIG. 2, the invention is not limited thereto. In addition, the head units 41 which are placed in the X direction may be shifted and arranged in the Y direction. In addition, a method of discharging ink from nozzles Nz may include, for example, a piezoelectric method of discharging ink in such a way that ink chambers are expanded and contracted by applying a voltage to piezoelectric elements, and a thermal method of generating bubbles in the nozzles Nz using heat generation elements and discharging ink using the bubbles.

The winding unit 50 includes a relay roller 51 that winds up and transmits the continuous sheet S which is transmitted from the pair of downstream-side transport rollers 34, and a winding drive shaft 52 that winds up the continuous sheet S which is transmitted from the relay roller 51. A printed continuous sheet S is wound in a roll shape in order in accordance with the rotary drive of the winding drive shaft 52.

Correction Value (Data Shift Value) Acquisition Method Outline

Figure 3:
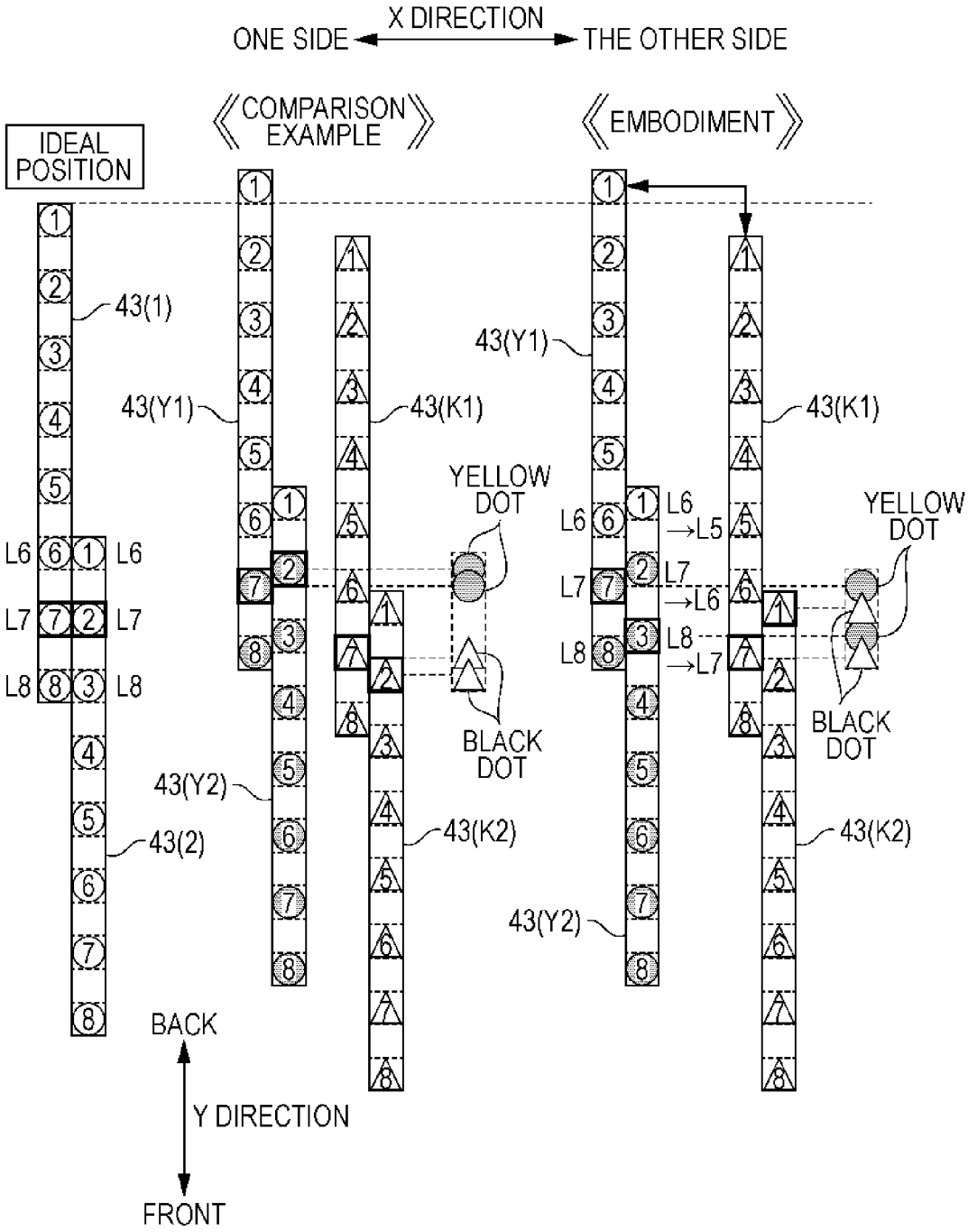
FIG. 3 is a view illustrating difference between a correction method according to a comparison example and a correction method according to an embodiment.
Figure 4:
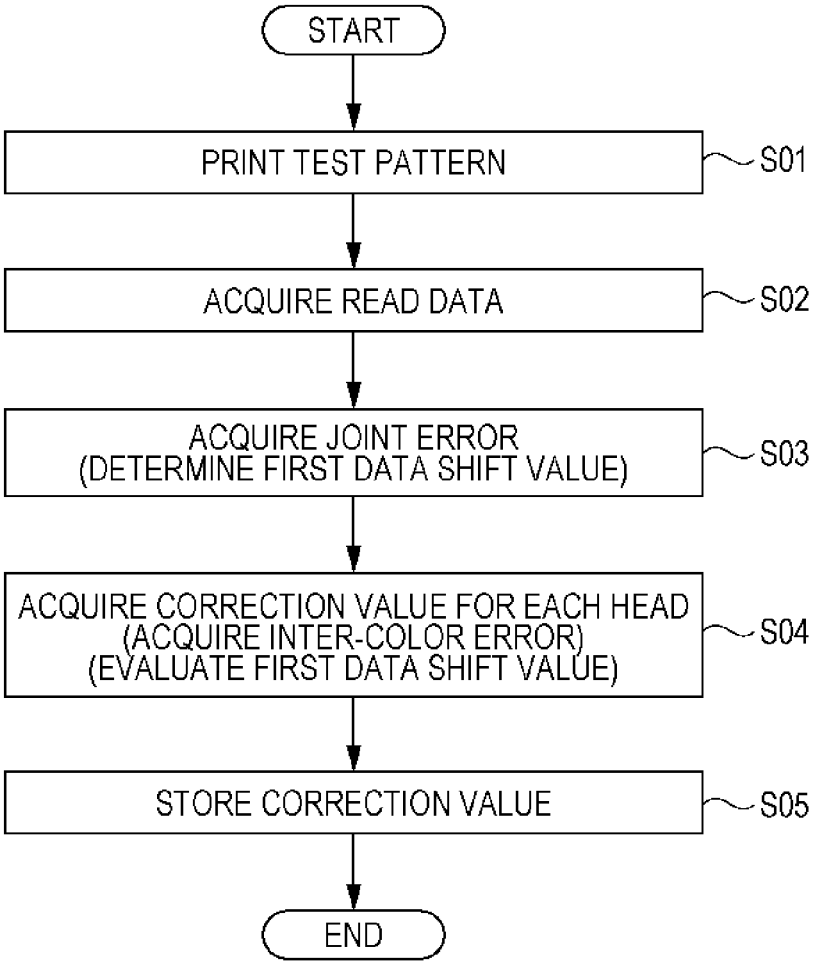
FIG. 4 is a flowchart illustrating a method of acquiring a correction value.

FIG. 3 is a view illustrating difference between a correction method according to a comparison example and a correction method according to the embodiment, and FIG. 4 is a flowchart illustrating a method of acquiring a correction value according to the embodiment. In FIG. 3, only a first head 43(1) and a second head 43(2) which are placed in the Y direction are shown, the number of nozzles which belong to a single nozzle row is set to 8, and the number of overlapping nozzles of the heads 43 which are adjacent in the Y direction is set to 3. In this case, when the heads 43 are attached in ideal positions as shown in the left drawing in FIG. 3, the same raster line (a dot row which is extended in the X direction) is printed by, for example, a nozzle #7 of the first head 43(1) and a nozzle #2 of the second head 43(2), and data (raster data) is assigned to print the raster line. In this way, it is possible to prevent a region which is printed at the joint portion (overlapping area) of the heads 43 from being distinguished due to the difference between properties of the heads 43 or deviation in the Y direction of the heads 43 which are adjacent in the Y direction. Hereinafter, in the heads 43 which are adjacent in the Y direction, nozzles that include a nozzle which belongs to an overlapping area of one head 43 (for example, the nozzle #7 of the first head 43(1)) and a nozzle which belongs to an overlapping area of the other head 43 (for example, the nozzle #2 of the second head 43(2)) and that print the same raster line are called "pair nozzles".

However, there is a case in which a head 43 is attached while being deviated from the ideal positions. For example, in FIG. 3, a second yellow head 43(Y2) is deviated from an ideal position on the back side of the Y direction with regard to a first yellow head 43(Y1), and a second black head 43(K2) is deviated from an ideal position on the front side of the Y direction with regard to a first black head 43(K1). Here, in the comparison example, correction is performed to determine optimal pair nozzles that print the same raster line based on the amount of deviation in the Y direction of the same color heads 43 which are adjacent in the Y direction. Therefore, in the comparison example, for example, the nozzle #2 of the second yellow head 43(Y2) which is the closest to the nozzle #7 of the first yellow head 43(Y1) is determined as the pair nozzle of the nozzle #7, and the nozzle #2 of the second black head 43(K2) which is the closest to the nozzle #7 of the first black head 43(K1) is determined as the pair nozzle of the nozzle #7. In this way, as shown in the middle drawing of FIG. 3, it is possible to reduce the amount of deviation in the Y direction of the yellow dots, and it is possible to reduce the amount of deviation in the Y direction of the black dots. However, the yellow dots and the black dots which should originally have been formed to overlap with each other are formed apart from each other in the Y direction. As above, in the correction method according to the comparison example, only the amount of deviation in the Y direction of the same color heads 43 which are adjacent in the Y direction is taken into consideration. Therefore, there are problems in that the deviation of formation positions of different color dots becomes worse due to the amount of deviation in the Y direction of different color heads 43, and the quality of printing image is deteriorated.

Here, in the embodiment, the pair nozzles are determined by also taking the amount of deviation in the Y direction (inter-color error) of the different color heads 43 into consideration in addition to the amount of deviation in the Y direction (joint error) of the same color heads 43 which are adjacent in the Y direction. For example, as shown in the right drawing in FIG. 3, the nozzle of the second yellow head 43(Y2), which is the closest to the nozzle #7 of the first yellow head 43(Y1), is the nozzle #2. However, the black heads 43 are deviated on the front side of the Y direction with regard to the yellow heads 43. Therefore, according to the correction method of the embodiment, there is a case in which the nozzle #3 of the second yellow head 43(Y2), which is deviated on the front side of the Y direction from the nozzle #7 of the first yellow head 43(Y1), is determined as a pair nozzle. In the same manner, there is a case in which the nozzle #1 of the second black head 43(K2), which is deviated on the back side of the Y direction from the nozzle #7 of the first black head 43(K1), is determined as a pair nozzle. Therefore, in the embodiment, it is possible to prevent the yellow dots from being aparted to much from the black dots while preventing the positions of the same color dots being deviated in the Y direction.

In addition, when pair nozzles are changed from the pair nozzles in an ideal state, it is necessary to shift the raster data assigned to each of the nozzles in the Y direction. For example, in FIG. 3, seventh raster data (L7) is assigned to the nozzle #7 of the first head 43(1) and the nozzle #2 of the second head 43(2) in the ideal state. At this time, when the pair nozzle of the nozzle #7 of the first yellow head 43(Y1) is changed to the nozzle #3 of the second yellow head 43(Y2), it is necessary to change the raster data which is assigned to the nozzle #3 from eighth raster data (L8) to the seventh raster data (L7).

Hereinafter, a method of acquiring a correction value, which is used to shift raster data assigned to each of the nozzles in the Y direction from data on the design (that is, data acquired when the heads 43 are attached to ideal positions) based on the amount of deviation in the Y direction (joint error) of the same color heads 43 which are adjacent in the Y direction and the amount of deviation in the Y direction (inter-color error) of different color heads 43.

Meanwhile, the method of acquiring the correction value described below is performed, for example, for each entity of the printer 1 when the printer 1 is manufactured or the method of acquiring the correction value is performed when the heads 43 are replaced by a user. In addition, when the correction value is acquired, a computer (not shown in the drawing) and a scanner (an image reading device, not shown in the drawing) in which a correction value acquisition program is installed are connected to a target printer 1. The correction value acquisition program is a program which causes the computer to execute processes described below, and can be stored in a computer-readable storage medium or can be downloaded through various communication devices.

S01: Print Test Pattern

Figure 5A:
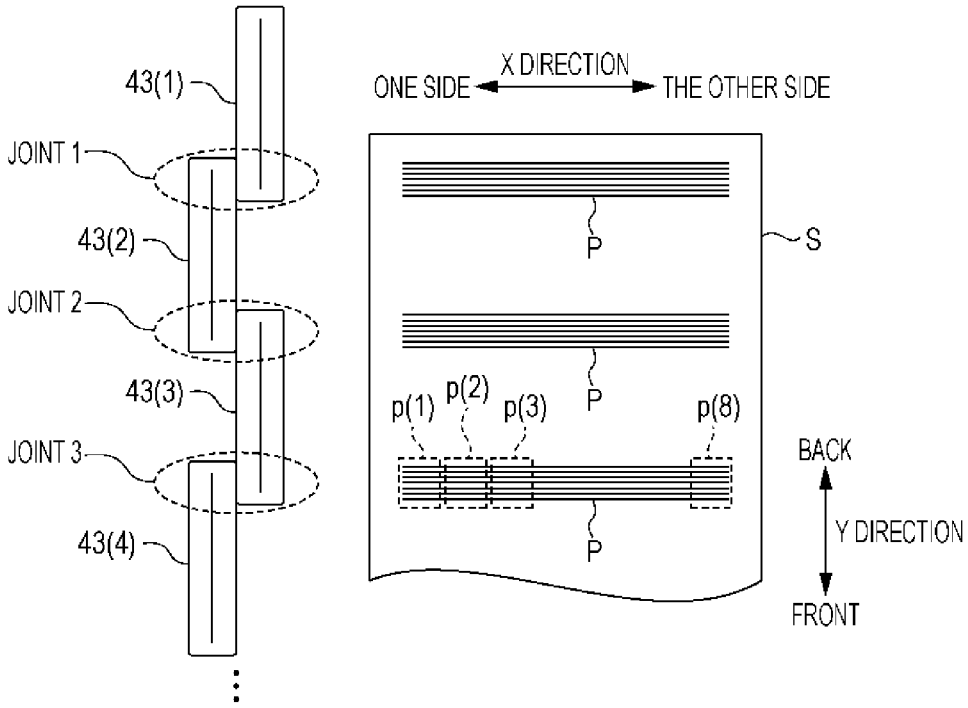
FIGS. 5A and 5B are explanatory views illustrating test patterns.
Figure 5B:
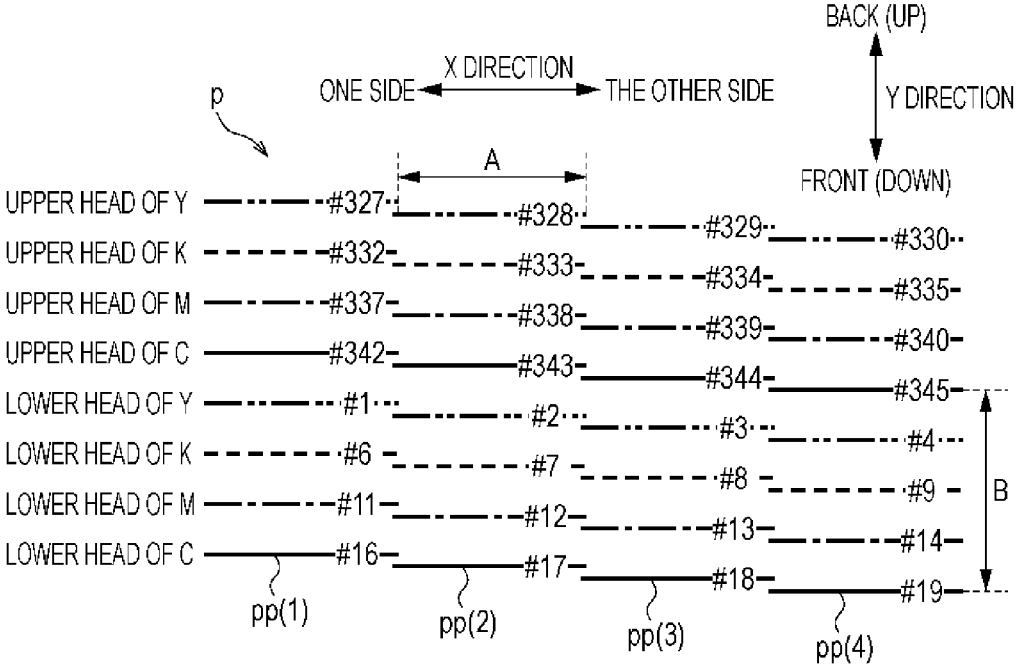

FIGS. 5A and 5B are explanatory views illustrating test patterns P. A computer, which is connected to a correction value acquisition target printer 1, first causes the four-color (CMYK) head units 41 to print test patterns P on a sheet S according to a correction value acquisition program. As shown in FIG. 5A, the test patterns P (patterns) are printed for the respective joints (for the respective overlapping areas) of the heads 43 which are adjacent in the Y direction. Since seven heads 43 are placed in the Y direction in each of the head units 41, six test patterns P are printed with intervals in the Y direction. A single test pattern P is printed by two heads 43 of each color (CMYK), which are adjacent in the Y direction, that is, a total of eight heads 43. For explanation below, a small number (i=1 to 6) is attached to a joint i of the heads 43, which are adjacent in the Y direction, in order from the back side of the Y direction. For example, a joint between the first head 43(1) and the second head 43(2) is set to a "joint 1". In addition, a head 43 which is located on the back side of the Y direction is called an upper head 43, and a head 43 which is located on the front side of the Y direction is called a lower head 43.

In addition, eight small patterns p(1) to p(8) which have the same configuration are placed in the X direction in each of the test patterns P as shown in FIG. 5A. Further, in the small patterns p, four ruled line groups pp(1) to pp(4), which are configured to include ruled lines (dot rows) extending in the X direction, are placed in the X direction as shown in FIG. 5B. In the ruled line group pp (dot row group), eight ruled lines respectively printed by two heads 43 of each color (CMYK), which are adjacent in the Y direction, are placed with intervals in the Y direction.

For example, in the ruled line group pp(1) which is located on one side in the X direction in the small pattern p of FIG. 5B, a ruled line formed by the nozzle #327 of the upper yellow head 43(*i*), a ruled line formed by the nozzle #332 of the upper black head 43(*i*), a ruled line formed by the nozzle #337 of the upper magenta head 43(*i*), a ruled line formed by the nozzle #342 of the upper cyan head 43(*i*), a ruled line formed by the nozzle #1 of the lower yellow head 43(*i*+1), a ruled line formed by the nozzle #6 of the lower black head 43(*i*+1), a ruled line formed by the nozzle #11 of the lower magenta head 43(*i*+1), and a ruled line formed by the nozzle #16 of the lower cyan head 43(*i*+1) are placed with intervals in the Y direction.

The four ruled line groups pp(1) to pp(4) which are placed in the X direction are configured to include ruled lines which are respectively printed by different nozzles. In FIG. 5B, nozzles, deviated on the front side of the Y direction by one from nozzles which print an arbitrary ruled line group (for example, pp(1)), print a ruled line group (for example, pp(2)) which is placed on the other side of the ruled line group in the X direction. Discharge properties differ between the nozzles, and thus there is a case in which impact positions are deviated because the amount of ink discharged from the nozzles is irregular or ink discharged from the nozzles flying bends. Therefore, if only one type of ruled line group pp is printed, a distance between the ruled lines in the Y direction is strongly affected by the discharge properties of the nozzles which print the ruled line group pp, and thus there is a problem in that it is difficult to acquire an appropriate correction value. Here, in the embodiment, printing is performed in such a way that a plurality of types of ruled line groups pp(1) to pp(4) are placed in the X direction, and the respective nozzles which print the ruled line groups pp(1) to pp(4) are differentiated. In this way, it is possible to acquire a correction value from which the influence of the difference between the discharge properties of the nozzles which print the test pattern P (ruled line groups pp) is reduced.

In addition, in the printer 1 according to the embodiment (FIG. 1B), the test patterns P are printed in such a way that the sheet S is transported in the X direction with regard to the head units 41. In addition, the test patterns P are read by a scanner. However, in a general scanner, a document is read in such a way that a line sensor moves in a predetermined direction (for example, X direction) with regard to the document (test patterns P). Therefore, if eight heads 43, which print a single test pattern P, have the nozzles which print the respective ruled lines at the same position in the Y direction, it is necessary to perform printing with the eight ruled lines being placed in the X direction, and thus ruled lines which are located on one side of the X direction are separated from the ruled lines which are located on the other side. In this way, a distance between the ruled lines in the Y direction is strongly affected by a transport error (meandering) of the sheet S or a read error of the scanner, and thus there is a problem in that it is difficult to acquire an appropriate correction value.

Here, in the embodiment, ruled lines, which are respectively printed by two heads 43 of each color (CMYK), which are adjacent in the Y direction, are placed in the Y direction. In this way, it is possible to acquire a correction value from which the influence due to the transport error of the sheet S and the read error of the scanner is reduced when the test pattern P is printed. Meanwhile, with regard to the length A of the ruled lines in the X direction, a length which is stably read when the positions of the ruled lines in the Y direction are read is secured, and the length A may be set to a length which is not affected by the transport error of the sheet S or the read error of the scanner due to the difference between the read positions of the ruled lines in the X direction (for example, the length A may be ¼ inches or less).

In addition, there is a case in which the sheet S, on which the test patterns P are printed, is expanded or contracted due to the influence of temperature and humidity. Therefore, if the interval between the ruled lines which are placed in the Y direction is much wide, an inter-ruled line distance in the Y direction is strongly affected by the expansion and contraction of the sheet S. On the other hand, if the interval between the ruled lines which are placed in the Y direction is much narrow, the ruled lines overlap with each other when ink discharged from the nozzles flying bends. Here, setting is made such that the maximum interval between the ruled lines for the acquisition of the inter-ruled line distance in the Y direction (for example, an interval B from a ruled line formed by the upper cyan head 43(*i*) to a ruled line formed by the lower cyan head 43(*i*+1)) is equal to or less than an allowable length, that is, an error of inter-ruled line distance, which is generated by the expansion or contraction of the sheet S, is included in an allowable range. In this way, it is possible to acquire a correction value from which influence due to the expansion or contraction of the sheet S is reduced.

S02: Acquire Read Data by Scanner

After the test patterns P (FIGS. 5A and 5B) are printed on the sheet S by the target printer 1, the computer causes a display device or the like to display an instruction such that the sheet S is set on the scanner (image reading device) by a worker. In this way, the computer acquires read data that is obtained in such a way that the test patterns P are read by the scanner. Meanwhile, it is assumed that a direction on the read data, which corresponds to the X direction (the transport direction of the sheet S) of the printer 1, is an X direction, and a direction on the read data, which corresponds to the Y direction (the width direction of the sheet S) of the printer 1, is a Y direction.

S03: Acquire Joint Error

Figure 6:
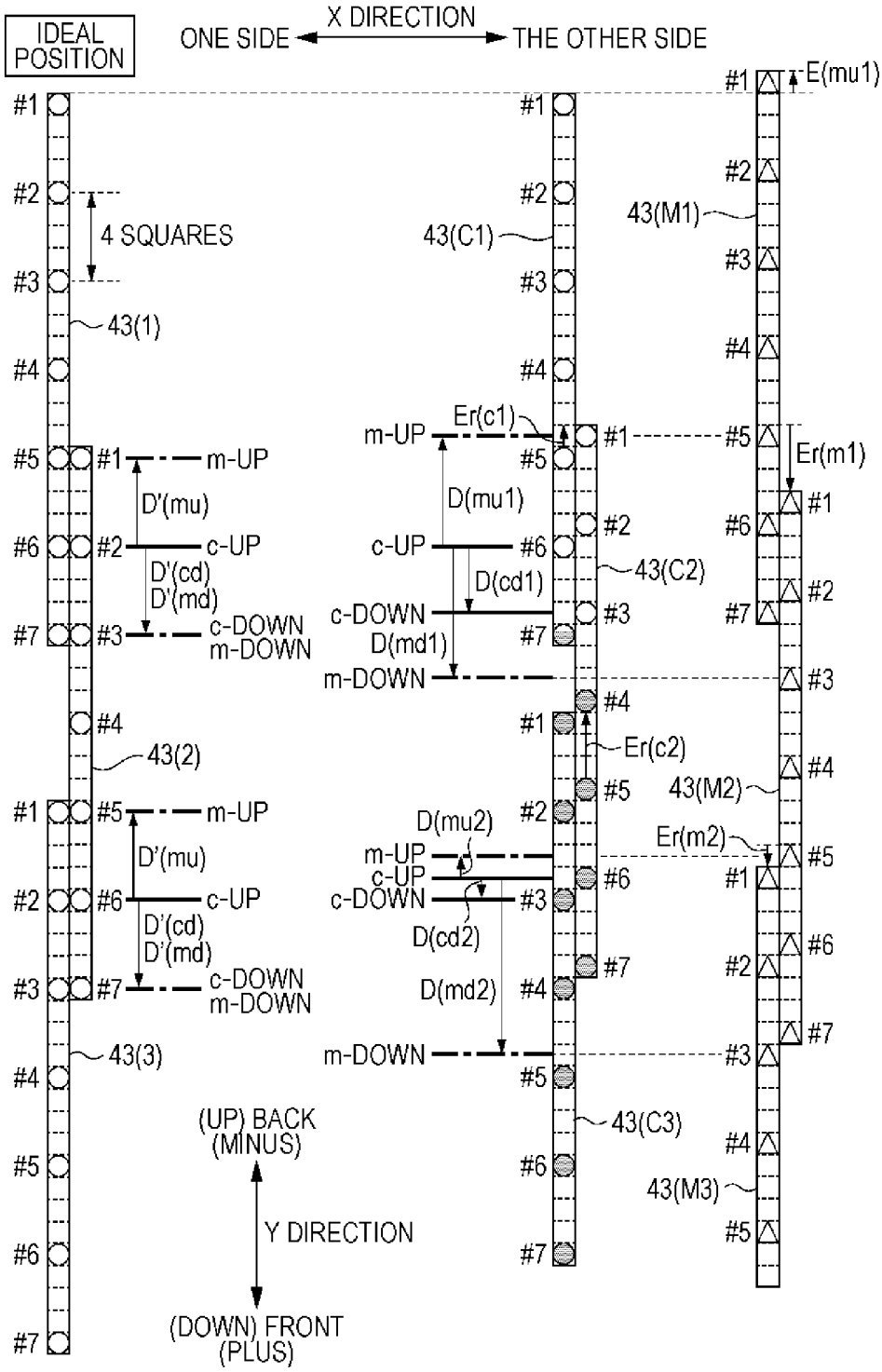
FIG. 6 is a view illustrating the method of acquiring the correction value.
Figure 7:
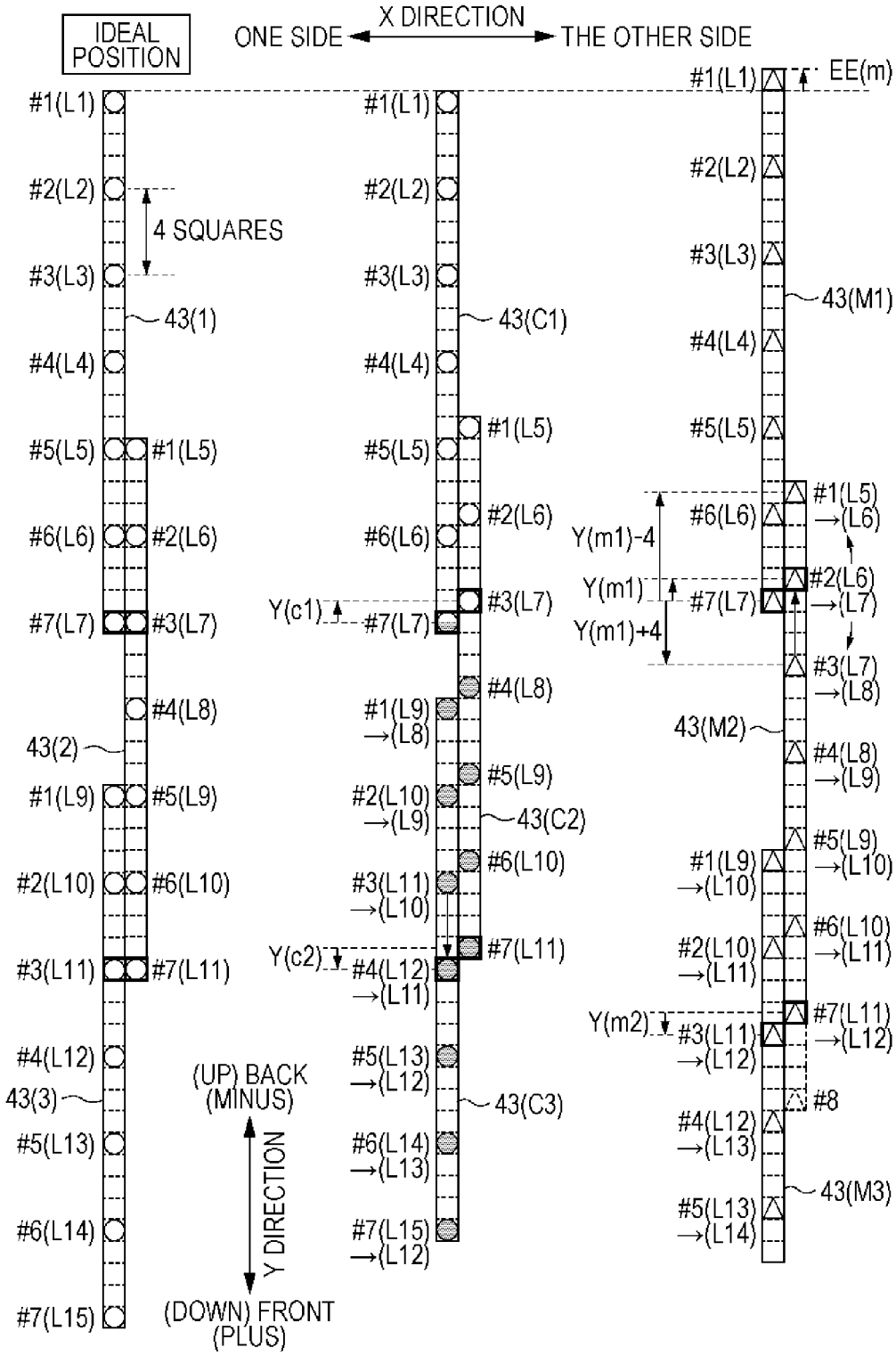
FIG. 7 is a view illustrating the method of acquiring the correction value.

FIGS. 6 and 7 are views illustrating the method of acquiring the correction value. Hereinafter, a first cyan head 43(C1) to a third cyan head 43(C3) and a first magenta head 43(M1) to a third magenta head 43(M3) will be described as examples. In addition, in FIGS. 6 and 7, it is assumed that the number of nozzles of a single nozzle row is 7 and the number of overlapping nozzles of the heads 43 which are adjacent in the Y direction is 3. In addition, it is assumed that the length of a single square in the Y direction shown in the drawings is 1. For example, an inter-nozzle pitch is 4. In addition, it is assumed that the back side of the Y direction is a "minus direction" and the front side is a "plus direction".

First, the computer acquires the positions of the ruled lines, which are included in the test patterns P, in the Y direction on the read data for the respective ruled lines based on the read data (result of reading) of the test patterns P acquired from the scanner. In FIG. 6, it is assumed that, a ruled line (c-up) formed by a nozzle #6 of an upper cyan head 43(Ci), a ruled line (c-down) formed by a nozzle #3 of a lower cyan head 43(Ci+1), a ruled line (m-up) formed by a nozzle #5 of an upper magenta head 43(Mi), and a ruled line (m-down) formed by a nozzle #3 of a lower magenta head 43(Mi+1) are printed at the joint i of the respective heads 43.

Subsequently, the computer acquires an "inter-ruled line distance D" which is a distance (vector distance) in the Y direction from a reference ruled line to another ruled line for each joint i of the heads 43. Here, it is assumed that a ruled line (c-up) formed by the upper cyan head 43(Ci) is a reference ruled line at each joint i of the heads 43. The inter-ruled line distance D is calculated by subtracting the position of the reference ruled line (c-up) in the Y direction from the position of each ruled line in the Y direction.

Description will be made in further detail with reference to FIG. 6. At the joint 1 of the heads 43, the inter-ruled line distance D(cu1) of the upper cyan head 43(C1) is "0", the inter-ruled line distance D(cd1) of the lower cyan head 43(C2) is "+3", the inter-ruled line distance D(mu1) of the upper magenta head 43(M1) is "−5", and the inter-ruled line distance D(md1) of the lower magenta head 43(M2) is "+6". In the same manner, at the joint 2 of the heads 43, the inter-ruled line distance D(cu2) of the upper cyan head 43(C2) is "0", the inter-ruled line distance D(cd2) of the lower cyan head 43(C3) is "+1", the inter-ruled line distance D(mu2) of the upper magenta head 43(M2) is "−1", and the inter-ruled line distance D(md2) of the lower magenta head 43(M3) is "+8".

Meanwhile, the test pattern P (FIGS. 5A and 5B) which is printed for each joint i of the heads 43 is configured to include a plurality of ruled line groups pp, and the ruled line formed by the upper cyan head 43(Ci) is included in the each ruled line group pp. Therefore, the inter-ruled line distance D up to another ruled line in each ruled line group pp is acquired by using the ruled line formed by the upper cyan head 43(Ci) in each ruled line group pp as the reference ruled line.

Subsequently, the computer acquires an "inter-ruled line error E (=D−D')" which is a value acquired by subtracting a logical distance D' from the inter-ruled line distance D. Here, it is assumed that the first cyan head 43(C1) is the reference head of all of the heads and the attachment position (dot formation position) of the first cyan head 43(C1) is a reference, and an ideal attachment position (ideal dot formation position) of each head 43 is determined as shown on the left drawing of FIG. 6. Further, the logical distance D' is the inter-ruled line distance of the ruled line which is printed when each head 43 is attached to the ideal position.

Description will be made in further detail with reference to FIG. 6. At the joint 1 of the heads 43, the inter-ruled line error E(cu1) of the upper cyan head 43(C1) is "0", the inter-ruled line error E(cd1) of the lower cyan head 43(C2) is "−1 (=(+3)−(+4))", the inter-ruled line error E(mu1) of the upper magenta head 43(M1) is "−1 (=(−5)−(−4))", and the inter-ruled line error E(md1) of the lower magenta head 43(M2) is "+2 (=(+6)−(+4)". In the same manner, at the joint 2 of the heads 43, the inter-ruled line error E(cu2) of the upper cyan head 43(C2) is "0", the inter-ruled line error E(cd2) of the lower cyan head 43(C3) is "−3 (=(+1)−(+4))", the inter-ruled line error E(mu2) of the upper magenta head 43(M2) is "+3 (=(−1)−(−4))", and the inter-ruled line error E(md2) of the lower magenta head 43(M3) is "+4 (=(+8)−(+4))".

Meanwhile, the inter-ruled line error E indicates the amount of deviation of another head 43 in the Y direction with regard to the upper cyan head 43(Ci) at each joint i of the heads 43. Further, since the ideal position of each head 43 is determined by using the first cyan head 43(C1) as the reference head of all of the heads, the inter-ruled line error E of the first head 43(1) indicates the amount of deviation of the head 43 in the Y direction from the ideal position thereof. For example, the inter-ruled line error E(mu1) of the first magenta head 43(M1) is "−1", and thus the first magenta head 43(M1) is deviated by 1 from the ideal position on the minus side of the Y direction as shown in FIG. 6.

In addition, since the test pattern P (FIGS. 5A and 5B) which is printed for each joint i of the heads 43 is configured to include the plurality of ruled line groups pp, a plurality of inter-ruled line errors E are acquired for each joint i of the heads 43. Therefore, the computer averages the plurality of inter-ruled line errors E which are acquired for each joint i of the heads 43, and uses the average value in the following processes. In this way, it is possible to acquire a correction value (inter-ruled line error E) from which the influences of the printing error of the test pattern P and the read error of the scanner are reduced.

In addition, since the first cyan head 43(1) is the reference head (first reference nozzle row), the head unit 41(C) that includes a nozzle row (first nozzle row) in which nozzles (first nozzles) for discharging cyan ink (first liquid) are placed corresponding to a first nozzle row group of the invention, and a head unit 41 that includes a nozzle row (second nozzle row) in which nozzles (second nozzles) for discharging another color (magenta, yellow, or black) ink (second liquid) are placed corresponding to a second nozzle row group of the invention.

Subsequently, the computer acquires the amount of deviation in the Y direction (the amount of deviation of a attachment position, the amount of deviation of a dot formation position) of the same color heads 43 which are adjacent in the Y direction. Here, the upper head 43(*i*) at each joint i of the heads 43 is used as a reference, and a "vertical error Er", that is, the amount of deviation of the lower head 43(*i*+1) in the Y direction with regard to the upper head 43(*i*) of the same color heads 43 which are adjacent in the Y direction, is acquired. The vertical error Er (Er(i)=E(i+1)−E(i)) is calculated by subtracting the inter-ruled line error E(i) of the upper head 43(*i*) from the inter-ruled line error E(i+1) of the lower head 43(*i*+1).

More specifically, at the joint 1 of the heads 43, a cyan vertical error Er (c1) is "−1 (=(−1)−0)", and a magenta vertical error Er (m1) is "+3 (=(+2)−(−1))". In FIG. 6, it is understood that the second cyan head 43(C2) is deviated by 1 on the minus side of the Y direction with regard to the first cyan head 43(C1) and the second magenta head 43(M2) is deviated by 3 on the plus side of the Y direction with regard to the first magenta head 43(M1). In the same manner, at the joint 2 of the heads 43, the cyan vertical error Er(c2) is "−3 (=(−3)−0)" and the magenta vertical error Er(m2) is "+1 (=(+4)−(+3))".

Subsequently, the computer determines a temporary pair nozzle set which causes the amount of deviation in the Y direction to be the minimum between the dot formation position of a nozzle, which is included in the overlapping area of one-side head 43 of the same color heads 43 which are adjacent in the Y direction, and the dot formation position of a nozzle (temporary pair nozzle), which is included in another head 43 and which forms the same raster line as the nozzle, based on the vertical error Er for each joint i of the heads 43. Further, "first data shift value S", which is the amount of shift of data assigned to each head 43 in the Y direction, is acquired for each head 43.

However, since the position of the upper head 43(*i*) is used as a reference at each joint i of the heads 43, the first data shift value S of the first head 43(1) is acquired based on the inter-ruled line error E. That is, the first data shift value S is acquired based on the amount of deviation of the first head 43(1) from the ideal position in the Y direction. More specifically, the first data shift value S of the first head 43(1) is calculated by causing a value which is acquired by dividing the inter-ruled line error E by the inter-nozzle pitch (+4) to be an integer value through rounding off. Hereinafter, rounding off of a value N is indicated as "Round(N)". Therefore, a calculating formula of the first data shift value S of the first head 43(1) is as following Equation.

$$S=\text{Round}(E/\text{inter-nozzle pitch})$$

In the case of FIG. 6, the first data shift value S(c1) of the first cyan head 43(C1) is "0=(Round(0/4))", and the first data shift value S(m1) of the first magenta head 43(M1) is "0=(Round(−1/4))".

Here, for example, as shown in the left drawing of FIG. 7, when the heads 43 are attached to the ideal positions, first raster data L1 is assigned to the nozzle #1 of the first head 43(1). However, when the first head 43(1) is greatly deviated from the ideal position in the Y direction, it is possible to cause the amount of deviation from the dot formation position of another color (in particular, cyan which is the reference) in the Y direction to be small if the first raster data L1 is assigned to nozzles (a nozzle #0 which is not shown in the drawing or the nozzle #2) which are deviated from the nozzle #1 in the Y direction.

As described above, since the first data shift value S of the first head 43(1) is a value which is acquired based on the inter-ruled line error E which is the amount of deviation from the ideal position, the first data shift value S indicates the amount of deviation from the nozzle #1 which is the optimal nozzle (a nozzle which has the minimum amount of deviation from another color head 43) to which the first raster data L1 is assigned. That is, the first data shift value S of the first head 43(1) indicates the amount of shift in the Y direction of data to be assigned to the head 43(1) such that the amount of deviation in the Y direction between the dot formation position of the head 43(1) and the dot formation position of the first cyan head 43(C1) is minimum. For example, in FIG. 7, since the first data shift value S(m1) of the first magenta head 43(M1) is 0, data which is assigned to the first magenta head 43(M1) is not shifted in the Y direction, and the first raster data L1 is assigned to the nozzle #1 of the first magenta head 43(M1).

In this way, after the first data shift value S of the first head 43(1) is acquired, the computer acquires the first data shift value S in order from a head 43 which is close to the first head 43(1). That is, the first data shift value S is acquired in order of the second head 43(2), the third head 43(3) . . . , and the seventh head 43(7). In the heads 43 subsequent to the second head, the first data shift value S is acquired based on the vertical error Er(i) which is the amount of deviation of the lower head 43(*i*+1) in the Y direction with regard to the same color upper head 43(*i*) at each joint i of the heads 43. In addition, if data which is assigned to the upper head 43(*i*) shifts, such a data shift propagates to the lower head 43(*i*+1). Therefore, it is also necessary to shift data which is assigned to the lower head 43(*i*+1). Therefore, the first data shift value S(i) of the head 43(*i*) subsequent to the second head is calculated by adding the first data shift value S(i−1) of the upper head 43(*i*−1) to a value which causes a value, acquired by dividing the vertical error Er by the inter-nozzle pitch(+4), to be converted into an integer value, as shown in the following Equation.

$$S(i)=\text{Round}(Er/\text{inter-nozzle pitch})+S(i-1)$$

More specifically, the first data shift value S(c2) of the second cyan head 43(C2) is "0 (=Round(−1/4)+0)", the first data shift value S(c3) of the third cyan head 43(C3) is "−1 (=Round(−3/4)+0)", the first data shift value S(m2) of the second magenta head 43(M2) is "1 (=Round(3/4)+0)", and the first data shift value S(m3) of the third magenta head 43(M3) is "1 (=Round(1/4)+1)".

For example, as shown in FIG. 7, when the heads 43 are attached to the ideal positions, the nozzle #7 of the upper head 43(*i*) and the nozzle #3 of the lower head 43(*i*+1) become the pair nozzles, and thus the same seventh raster data L7 is assigned thereto. Further, in FIG. 7, since the first data shift value S(c2) of the second cyan head 43(C2) becomes "0", the temporary pair nozzle (for example, nozzle #3) of the second cyan head 43(C2) with regard to the nozzle (for example, nozzle #7) which belongs to the overlapping area of the first cyan head 43(C1) is the same as in an ideal state, and thus data which is assigned to the second cyan head 43(C2) is not shifted in the Y direction.

On the other hand, since the first data shift value S(c3) of the third cyan head 43(C3) is "−1", the temporary pair nozzle of the third cyan head 43(C3) with regard to the nozzle (for example, nozzle #7) which belongs to the overlapping area of the second cyan head 43(C2) is deviated by 1 from the ideal state on the front side of the Y direction (for example, deviated from the nozzle #3 to nozzle #4), and data which is assigned to the third cyan head 43(C3) is deviated by 1 on the back side of the Y direction (minus side) (for example, data which is assigned to the nozzle #4 is deviated from 12-th raster data L12 to the 11-th raster data L11).

In addition, both the first data shift value S(m2) of the second magenta head 43(M2) and the first data shift value S(m3) of the third magenta head 43(M3) are "1". Therefore, although the temporary pair nozzle (for example, nozzle #3) of the third magenta head 43(M3) with regard to the nozzle (for example, nozzle #7) which belongs to the overlapping area of the second magenta head 43(M2) is the same as in an ideal state, data which is assigned to the third magenta head 43(M3) is deviated by 1 on the front side of the Y direction (plus side).

Subsequently, the computer acquires a "joint error Y (overlapping area error)" that is the amount of deviation of dots in the Y direction, which are respectively formed by the temporary pair nozzles of the same color heads 43 which are adjacent in the Y direction, for each joint i of the heads 43 (for each overlapping area) based on the data which is corrected using the first data shift value S. Based on the first data shift values S(i) and S(i+1) of the upper head 43(*i*) and the lower head 43(*i*+1) and the vertical error Er(i) of the joint i, a joint error Y(i) at the joint i is calculated as following Equation.

$$Y(i)=Er(i)-(S(i+1)-S(i))\times\text{inter-nozzle pitch}$$

More specifically, a cyan joint error Y(c1) at the joint 1 is "−1 (=−1−(0−0)×4)", and it is understood that the nozzle #3 of the second cyan head 43(C2), which is the temporary pair nozzle of the nozzle #7 of the first cyan head 43(C1), is deviated by 1 on the minus side of the Y direction with regard to the nozzle #7 of the first cyan head 43(C1) with reference to FIG. 7. In the same manner, a cyan joint error Y(c2) at the joint 2 is "+1 (=−3−(−1−0)×4)", a magenta joint error Y(m1) at the joint 1 is "−1 (=+3−(1−0)×4)", and the magenta joint error Y(m2) at the joint 2 is "+1 (=+1−(1−1)×4)".

S04: Acquire Correction Value for Each Head 43

The first data shift value S of the head 43 subsequent to the second head is acquired based on the amount of deviation in the Y direction (vertical error Er) of the same color heads 43 which are adjacent in the Y direction. Therefore, the computer subsequently evaluates the first data shift value S by taking the amount of deviation in the Y direction (inter-color error) of the different color heads 43 into consideration, and acquires a final data shift value SS (correction value) of each head 43.

First, the computer determines a final data shift value SS using the first head 43(1), which is used as a reference when the first data shift value S or the like is acquired, as a starting point. However, the first data shift value S of the first head 43(1) is the amount of shift of data which is calculated based on the inter-ruled line error E such that the amount of deviation between the ideal dot formation position and the actual dot formation position of the first head 43(1) is minimum. Therefore, the first data shift value S(1) of the first head 43(1) is adopted as the final data shift value SS without change. For example, when the first data shift value S(m1) of the first magenta head 43(M1) is "0", the final data shift value SS(m1) of the first magenta head 43(M1) is also "0".

Subsequently, for each color (CMYK), the computer acquires an "inter-color error EE (heterogeneous row error)" which is the amount of deviation in the Y direction between the position of a dot, formed by the first head 43(1) (second reference nozzle row) based on data corrected using the final data shift value SS (the amount of shift) of the first head 43(1) of each color, and an ideal dot formation position of the first head 43(1) (here, position which is the same as the dot formation position of the first cyan head 43(C1)) when the first cyan head 43(C1) is used as a reference. The inter-color error EE is calculated using the following Equation based on the inter-ruled line error E of the first head 43(1) and the final data shift value SS of the first head 43(1).

$$EE=E-(SS\times\text{inter-nozzle pitch})$$

More specifically, a cyan inter-color error EE(c) is "0 (=0−(0×4))", and a magenta inter-color error EE(m) is "−1 (=−1−(0×4))".

Subsequently, the computer acquires the final data shift value SS in order from a head 43 which is close to the first head 43(1) which is used as reference when the inter-color error EE is acquired (in order of the second head 43(2), the third head 43(3), . . . , and the seventh head 43(7)). In this way, it is possible to acquire the correction value by taking the amount of shift of data which propagates from the first head 43(1) to target head 43 into consideration.

Further, in order to acquire the final data shift value SS of the head 43 subsequent to the second head, the computer acquires the following three evaluation values for each head 43. Meanwhile, a joint i−1 included in the target head 43(*i*) and the joint error Y(i−1) of the joint i−1 (target overlapping area) on the side of the first head 43(1) of the joint i are used. A first evaluation value (r=0) is an evaluation value (third evaluation value) acquired by using the joint error Y(i−1) and the inter-color error EE, second evaluation value (r=−1) is an evaluation value (second evaluation value) acquired by using the correction joint error Y', which is a value acquired by subtracting the inter-nozzle pitch from the joint error Y(i−1), and the inter-color error EE, and a third evaluation value (r=+1) is an evaluation value (first evaluation value) acquired by using the correction joint error Y', which is a value acquired by adding the inter-nozzle pitch to the joint error Y(i−1), and the inter-color error EE. That is, an evaluation value (r=0), acquired when the temporary pair nozzles corresponding to the first data shift value adopted, and an evaluation value (r=±1), acquired when the temporary pair nozzles of the target head 43 are deviated by 1 in the Y direction from the temporary pair nozzles corresponding to the first data shift value S, are acquired.

The evaluation value is calculated by adding the absolute value of a value, acquired by multiplying a first weighting coefficient α by the correction joint error Y' (correction error), to absolute value of a value, acquired by multiplying a second weighting coefficient β by a value acquired by adding the inter-color error EE (heterogeneous row error) to the correction joint error Y', as expressed in the following equations.

$$\text{evaluation value}=\alpha\times|\text{correction joint error } Y'|+\beta\times|\text{inter-color error } EE+\text{correction joint error } Y'|$$

$$\text{correction joint error } Y'=\text{joint error } Y+r\times\text{inter-nozzle pitch}$$

Meanwhile, "r" is the shift amount of the temporary pair nozzles, and "−r" corresponds to the correction amount from the first data shift value S when the final data shift value SS is acquired. In addition, the additional value of the first weighting coefficient α and the second weighting coefficient β is 1 (β=1−α). Further, if the value of the first weighting coefficient α is increased, it is possible to put emphasis on correction with regard to the amount of deviation (joint error) of the same color heads 43 which are adjacent in the Y direction. Further, if the value of the second weighting coefficient β is increased, it is possible to put emphasis on correction with regard to the attachment error (inter-color error) of the different color heads 43. Therefore, it is possible to acquire a correction value by taking the joint error and the inter-color error into consideration based on the evaluation value. Meanwhile, in the embodiment, the first weighting coefficient α is a value which is equal to or greater than 0 and equal to or less than 0.2 (0≤α≤0.2). In addition, the first weighting coefficient α is 0.1, and the second weighting coefficient β is 0.9. However, the values of α and β are not limited thereto. In addition, the number of calculated evaluation values is not limited to 3, and, for example, five evaluation values may be calculated (r=−2, −1, 0, +1, +2).

Description will be made in further detail with reference to FIG. 7. Since the first data shift value S(m2) of the second magenta head 43(M2) is +1, the temporary pair nozzle of the second magenta head 43(M2) with regard to the nozzle #7 of the first magenta head 43(M1) in the overlapping area is determined as the nozzle #2. Therefore, an evaluation value, acquired when the temporary pair nozzle is set to the nozzle #2 without change (r=0), is "α+2β(=α×|−1+0×4+|+β×|−1+(−1)|)". On the other hand, an evaluation value, acquired when the temporary pair nozzle is deviated from the nozzle #2 to the nozzle #1 (r=−1), is "5α+6β(=α×|−1+(−1)×4+|β×|−1+(−5)|)", and an evaluation value, acquired when the temporary pair nozzle is deviated from the nozzle #2 to the nozzle #3 (r=+1), is "3α+2β(=α×|−1+(+1)×4|+β×|−1+(+3)|)".

As described above, the computer calculates three evaluation values with regard to the target head 43, and selects an evaluation value which causes the three evaluation values to be minimum. Further, the computer calculates the final data shift value SS(i) of the target head 43(*i*) using the following equation based on the shift amount r (value based on the correction joint error Y') of the temporary pair nozzle of the selected evaluation value, the first data shift value S(i) of the target head 43(*i*), and the final data shift value SS(i−1) of the upper head 43 (i−1) of the target head 43(*i*).

$$SS(i)=S(i)+(-r)+SS(i-1)$$

For example, if the evaluation value becomes the minimum when r=0 in the second magenta head 43(M2), the temporary pair nozzle corresponds to the first data shift value S(m2) without change. That is, as shown in FIG. 7, the temporary pair nozzle with regard to the nozzle #7 of the first magenta head 43(M1) is the nozzle #2 without change, and the final data shift value SS(m2) is "S(m2)+0+SS(m1)". On the other hand, if the evaluation value is the minimum when r=−1, the temporary pair nozzle with regard to the nozzle #7 of the first magenta head 43(M1) is deviated to the nozzle #1, and thus the final data shift value SS(m2) is "S(m2)+1+SS(m1)". In addition, if the evaluation value is the minimum when r=+1, the temporary pair nozzle with regard to the nozzle #7 of the first magenta head 43(M1) is deviated to the nozzle #3, and thus the final data shift value SS(m2) is "S(m2)+(−1)+SS(m1)".

The computer repeats the above processes, and acquires the final data shift value SS (correction value) of each head 43. Meanwhile, although the cyan head 43(C) and the magenta head 43(M) are described as examples up to here, a final data shift value SS for each head 43 is acquired in the same manner with regard to the yellow head 43(Y) and the black head 43(K).

In addition, in the embodiment, since the first cyan head 43(C1) is used as the reference head, the cyan inter-color error EE(c) is "0". Therefore, in the evaluation value calculation expression, values which are weighted using the weighting coefficients α and β become the same value (correction joint error Y'). Here, the final data shift value SS of the cyan head 43 may be acquired by using only the joint error Y (overlapping area error) at each joint i of the cyan head 43, and the evaluation value may not be calculated. That is, a first data shift value S of cyan may be adopted as the final data shift value SS without change. In this way, it is possible to easily process the method of acquiring the correction value, and it is possible to reduce a correction value acquisition time.

In addition, in the embodiment, the first cyan head 43(C1) is the reference head (first reference nozzle row) of the whole heads, and the inter-color error EE is calculated using the first head 43(1) (second reference nozzle row), which has the same position as the first cyan head 43(C1) in the Y direction, as a reference. However, the invention is not limited thereto. The two heads which are the references may be shifted in the Y direction. In addition, in the embodiment, the data shift value is an integer value (shift value in units of nozzles). However, the invention is not limited thereto. For example, the final data shift value SS of the head 43, which is the reference when the inter-color error is calculated, may be used as the inter-color error EE, and a value, acquired by integrating the correction joint error Y' (correction error) used when the evaluation value is calculated, may be acquired as the final data shift value SS (correction value) from the head 43 in order.

S05: Store Correction Value

With the above processes, when the first cyan head 43(1) is used as a reference head, that is, when the final data shift value SS(c1) of the first cyan head 43(1) is zero, a correction value (final data shift value SS), which causes data assigned to each head 43 to shift in the Y direction, is acquired. In the end, the computer stores the correction value SS which is acquired for each head 43 in the memory 13 (corresponding to a storage section) of the target printer 1, and ends the method of acquiring the correction value. Meanwhile, when the data shift value SS(c1) of the first cyan head 43(1) is a value other than zero, the data shift values SS of other heads 43 are values which are shifted in accordance therewith.

Further, when the printer 1 actually performs printing, correction is performed such that data assigned to each head 43 is shifted in the Y direction in the computer 70 which prepares printing data or the printer 1 which acquires the printing data based on a correction value stored in the memory 13. As a result, as shown in the above-described right drawing of FIG. 3, it is possible to prevent the deterioration of an image (the deviation of positions of the same color dots which are formed by the pair nozzles at the joint portion of the heads 43) due to the attachment error of the same color heads 43 which are adjacent in the Y direction, and it is possible to prevent the deterioration of an image (the deviation of positions of different color dots) due to the attachment error of different color heads 43.

Other Embodiment

The above embodiments are provided to easily understand the invention and do not limit the interpretation of the invention. The invention may be modified and amended without departing the gist thereof, and the invention includes the equivalents thereof.

In the embodiments, an example of the printer 1 is shown in which the head units 41 discharge ink with regard to the recording medium transported without stopping under the fixed head units 41 having nozzles placed over the length of the width of the recording medium. However, the invention is not limited thereto. The invention may be applied to, for example, a printer that repeats an operation of printing a 2-dimensional image in such a way that the head units discharge ink while moving in the X direction (direction crossing the nozzle row direction) and moves in the Y direction (nozzle row direction) with regard to the recording medium which is located in the printing area, and an operation of supplying a new portion of the recording medium to the printing area by transporting the recording medium in the X direction. In addition, the invention may be applied to, for example, a printer that repeats an operation of discharging ink while the head units move in the X direction (the direction crossing the nozzle row direction, the width direction of the recording medium), and a transport operation of transporting the recording medium in the Y direction (nozzle row direction, direction in which the medium is continued in a case of a continuous medium). In addition, the invention may be applied to, for example, a printer that repeats an operation of discharging ink to a recording medium which moves in the X direction with regard to the head units, and an operation of moving the recording medium in the Y direction with regard to the head units.

Although an ink jet printer is exemplified as an example of the liquid discharging apparatus in the embodiment, the invention is not limited thereto. For example, a liquid discharging apparatus, such as a color filter manufacturing apparatus, a display manufacturing apparatus, a semiconductor manufacturing apparatus, and a DNA chip manufacturing apparatus, may be used.

The entire disclosure of Japanese Patent Application No. 2013-071625, filed Mar. 29, 2013 is expressly incorporated by reference herein.

What is claimed is:

1. A method of acquiring a correction value of a liquid discharging apparatus that includes a first head having a first nozzle row formed in such a way that a plurality of first nozzles for discharging first liquid are placed in predetermined inter-nozzle pitch in a predetermined direction, a second head having a second nozzle row formed in such a way that a plurality of second nozzles for discharging the first liquid are placed in the predetermined inter-nozzle pitch in the predetermined direction, a third head having a third nozzle row formed in such a way that a plurality of third nozzles for discharging second liquid, a color of which is different from a color of the first liquid, are placed in the predetermined inter-nozzle pitch in the predetermined direction, and a fourth head having a fourth nozzle row formed in such a way that a plurality of fourth nozzles for discharging the second liquid are placed in the predetermined inter-nozzle pitch in the predetermined direction, wherein a part of the first nozzle row overlaps with a part of the second nozzle row and a part of the third nozzle row overlaps with a part of the fourth nozzle row when viewed from a direction crossing the predetermined direction, the method comprising:

acquiring a first heterogeneous row error which is an amount of deviation of a dot formation position actually formed by the third nozzle row in the predetermined direction with regard to the ideal position when a dot formation position formed by the first nozzle row is a reference position and a dot formation position, in which a dot formation position formed by the third nozzle row is an ideal position with regard to the reference position, is an ideal position;

acquiring a first overlapping area error which is an amount of deviation between a dot formation position formed by the first overlapping nozzle and a dot formation position formed by a second overlapping nozzle in the predetermined direction when viewed from a direction crossing the predetermined direction and when one of the third nozzles which is located in an overlapping area where the third nozzle row overlaps with the fourth nozzle row is a first overlapping nozzle and a nozzle in the plurality of fourth nozzles, which is capable of forming a dot having a closest dot formation position to the dot formation position formed by the first overlapping nozzle in the predetermined direction is the second overlapping nozzle; and acquiring a first correction value which causes discharge data assigned to the fourth nozzle row to shift in the predetermined direction based on the first heterogeneous row error and the first overlapping area error.

2. The method according to claim 1, wherein the acquiring of the first correction value includes:

using a value, acquired by adding the inter-nozzle pitch to the first overlapping area error, as a first correction error, and acquiring a first evaluation value using the first correction error and the first heterogeneous row error;

using a value, acquired by subtracting the inter-nozzle pitch from the first overlapping area error, as the first correction error, and acquiring a second evaluation value using the first correction error and the first heterogeneous row error;

using the first overlapping area error as the first correction error, and acquiring a third evaluation value using the first correction error and the first heterogeneous row error; and determining the first correction value based on a first minimum correction error which is the first correction error of an evaluation value having a smallest absolute value from among the first to third evaluation values.

3. The method according to claim 2, further comprising:

acquiring the evaluation value using a value acquired by adding an absolute value of a value, which is acquired by multiplying the first minimum correction error by a first weighting coefficient, to an absolute value of a value, which is acquired by multiplying a value acquired by adding the first minimum correction error to the first heterogeneous row error by a second weighting coefficient.

4. The method according to claim 2, wherein the liquid discharging apparatus further includes a fifth head having a fifth nozzle row formed in such a way that a plurality of fifth nozzles for discharging the second liquid are placed in the predetermined inter-nozzle pitch in the predetermined direction, and the third nozzle row does not overlap with the fifth nozzle row and the part of the fourth nozzle row overlaps with a part of the fifth nozzle row when viewed from a direction crossing the predetermined direction, wherein the method further comprises:

acquiring a second overlapping area error which is an amount of deviation between a dot formation position formed by a third overlapping nozzle and a dot formation position formed by a fourth overlapping nozzle in the predetermined direction when viewed from a direction crossing the predetermined direction and when one of the fourth nozzles, which is located in an overlapping area where the fourth nozzle row overlaps with the fifth nozzle row is the third overlapping nozzle and a nozzle in the plurality of fifth nozzles, which is capable of forming a dot having a closest dot formation position to the dot formation position formed by the third overlapping nozzle in the predetermined direction is the fourth overlapping nozzle; and acquiring a second correction value which causes discharge data assigned to the fifth nozzle row to shift in the predetermined direction, and wherein the acquiring of the second correction value includes acquiring the second correction value based on the first minimum correction error, the first heterogeneous row error, and the second overlapping area error.

5. A method of manufacturing a liquid discharging apparatus that includes a first head having a first nozzle row formed in such a way that a plurality of first nozzles for discharging first liquid are placed in predetermined inter-nozzle pitch in a predetermined direction, a second head having a second nozzle row formed in such a way that a plurality of second nozzles for discharging the first liquid are placed in the predetermined inter-nozzle pitch in the predetermined direction, a third head having a third nozzle row formed in such a way that a plurality of third nozzles for discharging second liquid, a color of which is different from a color of the first liquid, are placed in the predetermined inter-nozzle pitch in the predetermined direction, a fourth head having a fourth nozzle row formed in such a way that a plurality of fourth nozzles for discharging the second liquid are placed in the predetermined inter-nozzle pitch in the predetermined direction, and a storage section, wherein a part of the first nozzle row overlaps with a part of the second nozzle row and a part of the third nozzle row overlaps with a part of the fourth nozzle row when viewed from a direction crossing the predetermined direction, the method comprising:

acquiring a first heterogeneous row error which is an amount of deviation of a dot formation position actually formed by the third nozzle row in the predetermined direction with regard to the ideal position when a dot formation position formed by the first nozzle row is a reference position and a dot formation position, in which a dot formation position formed by the third nozzle row is an ideal position with regard to the reference position, is an ideal position;

acquiring a first overlapping area error which is an amount of deviation between a dot formation position formed by a first overlapping nozzle and a dot formation position formed by a second overlapping nozzle in the predetermined direction when viewed from a direction crossing the predetermined direction and when one of the third nozzles which is located in an overlapping area where the third nozzle row overlaps with the fourth nozzle row is the first overlapping nozzle and a nozzle in the plurality of fourth nozzles, which is capable of forming a dot having a closest dot formation position to the dot formation position formed by the first overlapping nozzle in the predetermined direction is the second overlapping nozzle;

acquiring a first correction value which causes discharge data assigned to the fourth nozzle row to shift in the predetermined direction based on the first heterogeneous row error and the first overlapping area error; and storing the first correction value in the storage section.

* * * * *